US005257608A

United States Patent [19]

Harde

[11] Patent Number: 5,257,608

[45] Date of Patent: Nov. 2, 1993

[54] DEVICE IN A FUEL SYSTEM FOR AN INTERNAL COMBUSTION ENGINE

[75] Inventor: Bo Harde, Gothenburg, Sweden

[73] Assignee: AB Volvo, Gothenburg, Sweden

[21] Appl. No.: 842,341

[22] PCT Filed: Sep. 17, 1990

[86] PCT No.: PCT/SE90/00595

§ 371 Date: Mar. 25, 1992

§ 102(e) Date: Mar. 25, 1992

[87] PCT Pub. No.: WO91/05159

PCT Pub. Date: Apr. 18, 1991

[30] Foreign Application Priority Data

Sep. 27, 1989 [SE] Sweden ..... 8903181

[51] Int. Cl.[5] ..... B67D 5/54; F02D 39/00

[52] U.S. Cl. ..... 123/510; 137/207.5

[58] Field of Search ..... 123/510, 514, 456, 196 S; 137/207.5

[56] References Cited

U.S. PATENT DOCUMENTS

| | | | |
|---|---|---|---|
| 2,070,517 | 2/1937 | O'Leary | 137/207.5 |
| 2,081,204 | 5/1937 | Nigbor | 137/207.5 |
| 2,082,137 | 6/1937 | Baker | 137/207.5 |
| 4,314,539 | 2/1982 | Schade | 123/514 |
| 4,706,636 | 11/1987 | Davis | 123/514 |
| 4,878,474 | 11/1989 | Hack, Jr. | 123/456 |
| 4,898,140 | 2/1990 | Pages | 123/510 |
| 5,002,030 | 3/1991 | Mahnke | 123/456 |
| 5,062,398 | 11/1991 | Bedi et al. | 123/196 S |
| 5,070,831 | 12/1991 | Yunick | 123/196 S |
| 5,074,272 | 12/1991 | Bostick et al. | 123/514 |

FOREIGN PATENT DOCUMENTS 2573509 5/1986 France .

*Primary Examiner*—E. Rollins Cross
*Assistant Examiner*—Thomas Moulis
*Attorney, Agent, or Firm*—Burns, Doane, Swecker & Mathis

[57] ABSTRACT

The invention relates to a device in a fuel system for an internal combustion engine (1) with a fuel injection device. The fuel system comprises a fuel tank (2), a feeder line (3) for feeding fuel from the fuel tank (2) to the fuel injection device (4, 6, 7), return line (5) for returning excess fuel from the fuel injection device to the fuel tank. According to the invention, a coupling (11) is arranged in the feeder line (3) in the vicinity of its end in the fuel tank (2). The coupling (11) has two open connections for the feeder line (3) with free through-flow for the fuel and a pressure medium connection which is closed during normal operation, through which connection pressure medium can be introduced to force the fuel from the fuel system. A check valve is arranged in the feeder line (3) between the coupling (11) and the end of the feeder line (3) in the fuel tank (2), said check valve permitting flow in the feeder line (3) only in the direction from the fuel tank (2).

3 Claims, 2 Drawing Sheets

DEVICE IN A FUEL SYSTEM FOR AN INTERNAL COMBUSTION ENGINE

The invention relates to a device in a fuel system for an internal combustion engine with a fuel injection device, said fuel system comprising a fuel tank, a feeder line for feeding fuel from the fuel tank to the fuel injection device and a return line for returning excess fuel from the fuel injection device to the fuel tank.

More and more internal combustion engines are being provided with fuel injection devices, which permit, with the aid of various mechanical and/or electronic control means, exact regulation of the fuel supply to the engine in response to various operating parameters. The fuel systems for feeding fuel to the engines are usually designed as circulation systems, there being a feeder line with a pump for supplying fuel to the fuel injection device and a return line for returning excess fuel to the fuel tank. The pump has sufficient capacity to provide a fuel flow corresponding to a maximum fuel consumption. At lower fuel comsumption, the excess fuel is returned to the fuel tank.

When servicing the components of the fuel system or replacing such components, it is necessary to at least partially disassemble the fuel system. Due to the fact that the fuel system contains a relatively large number of components, it also contains a relatively large amount of fuel which will flow out when the fuel system is disassembled. This can give rise to problems, since the fuel usually contains environmentally dangerous components which are, for example, toxic, inflammable and/or allergenic. There is therefore a clear need to reduce fuel spills in workshops and similar places.

The invention intends to solve the above mentioned problem and provide a device of the type described by way of introduction which makes it possible to reduce to a negligible amount fuel spills when servicing or repairing the fuel system. This is achieved by a device with the features disclosed in the characterizing clause of claim 1.

Suitable embodiments of the device according to the invention are defined in the subclaims.

Figure 1:
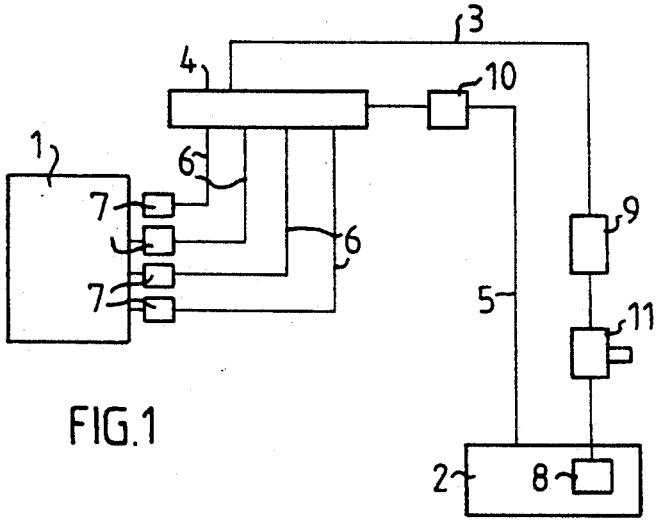
Figure 2:
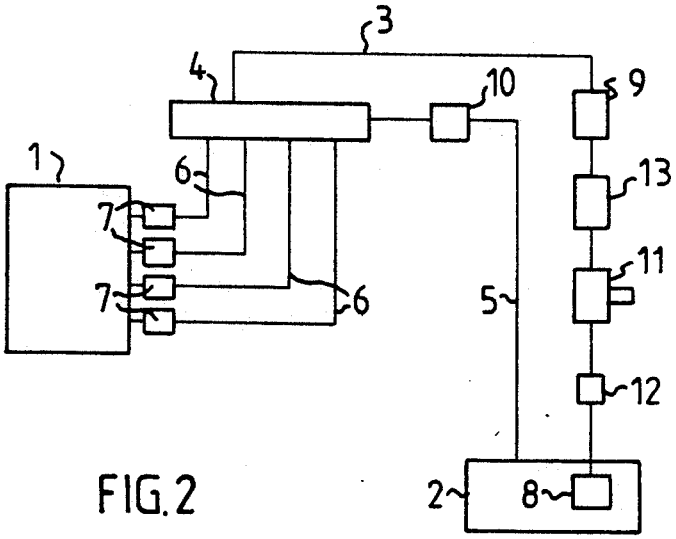
Figure 3:
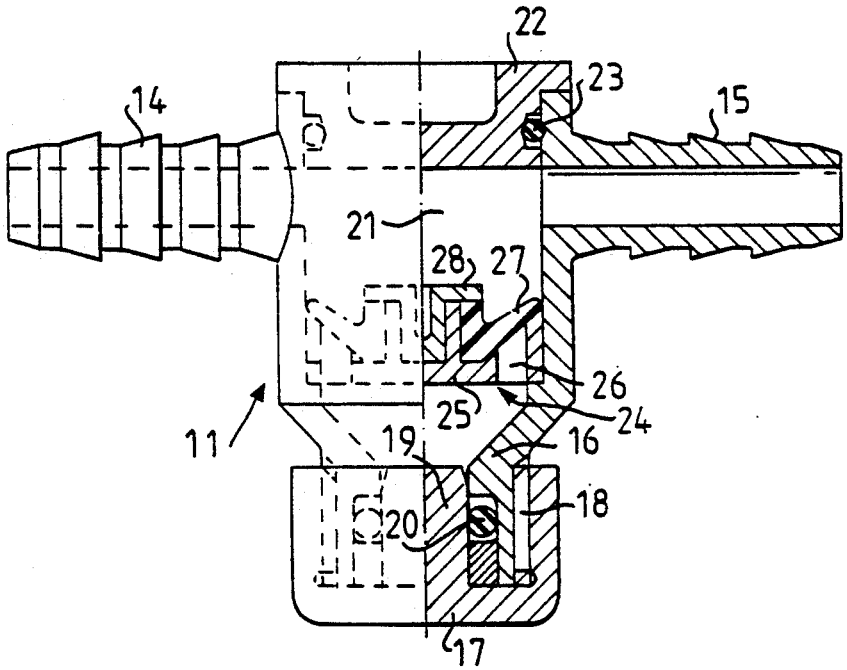

The invention will be described in more detail below with reference to the accompanying drawings, of which FIG. 1 is a schematic view of a fuel system with a device according to one embodiment of the invention, FIG. 2 shows a schematic view of a second fuel system with the device according to an embodiment of the invention, and FIG. 3 shows a partially cut-away view of a coupling included in a device according to the invention.

FIG. 1 shows schematically a combustion engine 1 provided with a fuel system with a device according to the invention. The fuel system comprises a fuel tank 2, a feeder line 3 for feeding fuel from the fuel tank 2 to a fuel distributor pipe 4 in a fuel injection device and a return line 5 for returning excess fuel to the fuel tank 2. The fuel injection device comprises, in addition to the distributor pipe 4, a number of injector pipes 6 extending from the distributor pipe 4 to individual injector valves 7, via which fuel is injected into the engine intake pipes (not shown).

In the fuel tank 2 there is a fuel pump 8, connected to the feeder line 3 for feeding fuel to the distributor pipe 4 in the fuel injection device. The fuel pump 8 is provided with a check valve to prevent back flow of fuel through the feeder line 3 when the fuel pump 8 is not operating. In the feeder line 3 there is also a fuel filter 9. The return line 5 contains a pressure regulator 10 to maintain a predetermined pressure in the fuel injection device, e.g. in the distributor pipe 4 and the injection pipe 6 as well as in the feeder line 3.

In the feeder line 3 there is also a coupling 11, which is shown in more detail in FIG. 3 and will be described in more detail below.

FIG. 2 shows an internal combustion engine 1 with a fuel system which is somewhat modified from that shown in FIG. 1. The components which have direct counterparts in FIG. 1 have been provided with the same reference numerals. In the embodiment shown in FIG. 2, the fuel pump 8 in the fuel tank 2 is a pre-pump without any check valve. Furthermore, there is a separate check valve 12 in the feeder line 3. There is also a main fuel pump 13 in the feeder line 3. The coupling 11 is coupled into the feeder line 3 between the check valve 12 and the main fuel pump 13.

The coupling 11 in the fuel systems according to FIGS. 1 and 2 is shown on a larger scale and partially cut away in FIG. 3. The coupling 11 has two open connections 14 and 15, which are connected to the feeder line 3, and a pressure medium connection 16 which is closed when the engine 1 and the fuel system is functioning normally. The pressure medium connection 16 is closed by means of a cover 17 screwed onto an external thread 18 on the pressure medium connection 16 and having a plug 19 protruding into the opening in the pressure medium connection 16 and being sealed by means of a sealing ring 20.

Inside the coupling 11, there is a cylindrical chamber 21 in communication with the connections 14 and 15 and the pressure medium connection 16. The chamber 21, at its end remote from the pressure medium connection 16, is closed by means of a cover 22 with a sealing ring 23.

The pressure medium connection 16 is in communication with the chamber 21 via a check valve 24 which is intended to prevent fuel from running out through the pressure medium connection 16 when the cover 17 has been removed. The check valve 24 consists of an insert 25 covering the entire cross-section of the chamber 21 and provided with a number of through-holes 26, and an elastic element 27 in the form of a truncated hollow cone, said element being normally disposed to close the holes 26 in the insert 25 to prevent fuel from the chamber 21 from entering the pressure medium connection 16. The element 27 is also made in such a manner that its outer circumference is in contact with the inner wall of the chamber 21 to further improve its sealing function. The element 27 is held on the insert 25 by a fastening means 28 fixed to the insert 25 and extending over a portion of the element 27.

When the internal combustion engine 1 and the fuel system are in normal operation, the pressure medium connection 16 is closed, the check valve 24 being closed and the cover 17 being in place. The connections 14 and 15 and the chamber 21 in the coupling 11 function in this case as a portion of the feeder line 3 and do not affect the function of the fuel system. When the fuel system with its fuel injection device is serviced or repaired, it is desirable to be able to evacuate the fuel system of fuel in order to avoid unnecessary spilling of fuel. For this purpose the cover 17 is removed from the pressure medium connection 16 and a pressure medium source, for example a compressed air source (not shown), is connected to the pressure medium connection 16. Compressed air blown through the pressure medium connection 16 acts on the check valve 24 and the element 27 is forced away from the holes 26 for open communication with the chamber 21. The compressed air, which must have a pressure exceeding the set pressure of the pressure regulator 10, then forces the fuel from the feeder line 3, including the fuel filter 9, the main fuel pump 13 if present, the distributor pipe 4, the pressure regulator 10 and the return line 5, thus returning this fuel to the fuel tank 2. Service and possible repair of the various components of the fuel system can then be done without any unnecessary spilling of fuel. After the fuel has been blown out of the fuel system, the supply of compressed air through the pressure medium connection 16 is shut off, and the check valve 24 returns to its closed position by the element 27 sealing off the holes 26. The cover 17 is thereafter screwed onto the pressure medium connection 16. After reassembly of the various components of the fuel system, the system can be used again, with the coupling 11 being a part of the feeder line 3 without affecting the function of the system.

I claim:

1. Device in a fuel system for an internal combustion engine with a fuel injection device, said fuel system including a fuel tank, a feeder line for feeding fuel from the fuel tank to the fuel injection device and a return line for returning excess fuel from the fuel injection device to the fuel tank, comprising a coupling arranged in the feeder line in the vicinity of an end of the feeder line in the fuel tank, said coupling having two open connections for the feeder line with free through-flow for the fuel and a pressure medium connection closed during normal operation, through which connection pressure medium can be introduced to force the fuel out of the fuel system, and a check valve arranged in the feeder line between the coupling and the end of the feeder line located in the fuel tank, said check valve only permitting flow in the feeder line in the direction away from the fuel tank.

2. Device according to claim 1, wherein the pressure medium connection of the coupling is provided with a check valve for preventing fuel from flowing out through the pressure medium connection.

3. Device according to claim 2, wherein the check valve in the coupling has an element of elastic material in the form of a hollow truncated cone, which is arranged in normal operation to cover at least one opening in an insert in the pressure medium connection and to expose the opening under the influence of the pressure medium when pressure medium is introduced through the pressure medium connection.

* * * * *